US009694264B2

(12) United States Patent
Bom

(10) Patent No.: US 9,694,264 B2
(45) Date of Patent: Jul. 4, 2017

(54) GOLF BAG WITH COLLAPSIBLE FEATURE

(71) Applicant: Bordeso B.V., The Netherlands (NL)

(72) Inventor: Petrus Leonardus Josef Bom, The Netherlands (NL)

(73) Assignee: Bordeso B.V., Leusden (NL)

( * ) Notice: Subject to any disclaimer, the term of this patent is extended or adjusted under 35 U.S.C. 154(b) by 0 days.

(21) Appl. No.: 14/910,368

(22) PCT Filed: Aug. 5, 2014

(86) PCT No.: PCT/NL2014/050548
§ 371 (c)(1),
(2) Date: Feb. 5, 2016

(87) PCT Pub. No.: WO2015/020521
PCT Pub. Date: Feb. 12, 2015

(65) Prior Publication Data

US 2016/0175670 A1 Jun. 23, 2016

(30) Foreign Application Priority Data

Aug. 5, 2013 (NL) ..... 2011271

(51) Int. Cl.
*A63B 55/00* (2015.01)
*A63B 55/40* (2015.01)
(Continued)

(52) U.S. Cl.
CPC ..... *A63B 55/40* (2015.10); *A63B 55/00* (2013.01); *A63B 55/404* (2015.10); *A63B 55/57* (2015.10);
(Continued)

(58) Field of Classification Search
CPC ..... A63B 55/40; A63B 55/408; A63B 55/57; A63B 55/404; A63B 55/00
(Continued)

(56) References Cited

U.S. PATENT DOCUMENTS 2,732,871 A 1/1956 Drown
3,779,297 A 12/1973 Stammer
(Continued)

FOREIGN PATENT DOCUMENTS

JP 01-126983 A 5/1989
SE 214555 C1 8/1967
(Continued)

OTHER PUBLICATIONS

European Patent Office; International Search Report and Written Opinion issued in corresponding International Application No. PCT/NL2014/050548. Date of Mailing: Oct. 21, 2014.
(Continued)

*Primary Examiner* — Sue A Weaver
(74) *Attorney, Agent, or Firm* — Fishman Stewart PLLC

(57) ABSTRACT

Golf bag, comprising a front panel and a back panel having therebetween a bundle of shaft receptacles for therein receiving a golf club by the shaft thereof. Front and back panel are pivotably connected with each other at a bottom of the golf bag, and are adjustable relative to each other between a collapsed, substantially flat position in which front and back panel run substantially along each other, and a folded-out, substantially wedge-shaped position in which front and back panel diverge and in which between their free ends a presentation surface is located. The shaft receptacles terminate in the presentation surface and with mutual spacing are grouped in rows which nm along each other with an intermediate distance, so that golf clubs whose shaft is received in a shaft receptacle have their heads positioned on the presentation surface in rows spaced apart with an intermediate distance.

14 Claims, 10 Drawing Sheets

(51) Int. Cl.
*A63B 55/57* (2015.01)
*A63B 55/50* (2015.01)

(52) U.S. Cl.
CPC ..... *A63B 55/50* (2015.10); *A63B 2055/403* (2015.10)

(58) Field of Classification Search
USPC ..... 206/315.2, 315.3, 315.6, 315.7; 248/96
See application file for complete search history.

(56) References Cited

U.S. PATENT DOCUMENTS 5,605,310 A * 2/1997 Jungkind ..... A63B 55/50 206/315.7
5,687,843 A * 11/1997 Yuill ..... A63B 55/00 206/315.3
6,155,418 A * 12/2000 Chang ..... A63B 55/00 206/315.6
6,216,865 B1 * 4/2001 Maeng ..... A63B 55/00 206/315.3
8,256,610 B2 * 9/2012 Michas ..... A63B 55/53 206/315.3
2002/0170839 A1 * 11/2002 Chang ..... A63B 55/00 206/315.6
2004/0238387 A1 * 12/2004 Heidenreich ..... A63B 55/00 206/315.3
2008/0169212 A1 * 7/2008 Quartarone ..... A63B 55/53 206/315.7

FOREIGN PATENT DOCUMENTS

WO 91/10483 A1 7/1991
WO 97/30766 A1 8/1997
WO 2006/045040 A2 4/2006

OTHER PUBLICATIONS

European Examination Report, 14758696.0-1658, dated Apr. 7, 2017.

* cited by examiner

GOLF BAG WITH COLLAPSIBLE FEATURE

CROSS-REFERENCE TO RELATED APPLICATIONS

This application is a national stage filing based upon International PCT Application No. PCT/NL2014/050548, with an international filing date of Aug. 5, 2014, which claims the benefit of priority to NL Application No. 2011271, filed Aug. 5, 2013, each of which applications are fully incorporated herein by reference as though fully set forth herein.

TECHNICAL FIELD

The invention relates to a golf bag.

BACKGROUND

Golf bags are generally known and are intended to accommodate a set of golf clubs, for instance during storage, transport and play.

A golf bag must be able to accommodate the clubs, which often differ strongly mutually in shaft length and head shape, in a conveniently arranged manner. A standard set of golf clubs comprises, for instance, as many as 14 clubs, for instance one or more fairway woods, drivers, putters, irons, and a sand wedge. A set of golf clubs can easily weigh some 10 kilograms, and is often relatively costly.

A golf bag must not only accommodate the set of clubs in a conveniently arranged manner, but also provide proper protection and at the same time be light of weight. Also, a golf bag must be easy to handle, and take up little space during transport. The classic golf bag—a large tube provided with a shoulder strap—poorly meets the above-mentioned criteria, and has been the point of departure for all kinds of innovation attempts.

In practice, however, it has proved to be difficult to meet the above-mentioned criteria to a sufficient extent at the same time. As a consequence, in practice, the classic golf bag is still widely used. The object of the invention is to provide a golf bag having an improved design, and which is more satisfactory on at least a number of the points mentioned, in particular, having a design that is light of weight, that protects the golf clubs well, that is compact and well manageable during transport, and that can present the set of golf clubs in a conveniently arranged manner.

SUMMARY

To this end, the invention provides a golf bag comprising a front panel and a back panel having therebetween a bundle of shaft receptacles for therein receiving a golf club by the shaft thereof, wherein front and back panel are pivotably connected with each other at a bottom of the golf bag, and are adjustable relative to each other between a collapsed, substantially flat position in which front and back panel run substantially along each other, and a folded-out, substantially wedge-shaped position in which front and back panel diverge and in which between their free ends a presentation surface is located in which the shaft receptacles terminate and with mutual spacing are grouped in rows which run along each other with an intermediate distance, so that golf clubs whose shaft is received in a shaft receptacle have their heads positioned on the presentation surface in rows spaced apart with an intermediate distance.

By providing a front panel and a back panel having between them a bundle of shaft receptacles, a construction can be provided which can be made of firm and lightweight design, while yet providing good protection.

In the substantially flat position in which front and back panel run substantially along each other, the golf bag is relatively easy to handle. The golf bag in the substantially flat position can, for instance, be conveniently carried under the arm. In the substantially wedge-shaped position in which front and back panel diverge, room can be created for setting up between the front and back panel a presentation surface, on which the golf clubs by way of their heads can be presented in a conveniently arranged manner.

By providing a bundle of shaft receptacles, extending between the front and back panel, which terminate in the presentation surface and which are grouped in rows, the golf clubs can be individually received by their shaft in a shaft receptacle, so that the head of the golf club is positioned on the presentation surface. By grouping the shaft receptacles in rows spaced apart with an intermediate distance, the heads in the different rows can, upon collapse, be moved towards each other, so that the intermediate distance between the spaced apart rows is reduced. Owing to the mutual spacing between the shaft receptacles in the rows, the heads of the different rows can then be received between each other, for instance alternately.

The presentation surface may be formed by an upper panel which extends between the free ends of the front and back panels. By providing such an upper panel, the presentation surface can be realized in a simple manner. The upper panel is preferably extended in the folded-out position of front and back panel, and unextended in the collapsed position. The presentation surface can then be set up in the folded-out position of front and back panel, and folded-in in the collapsed position. In its set-up condition, the presentation surface can present the shaft receptacles well, and in its folded-in position it can be put away compactly. By making the upper panel of flexible design, its folding in and folding out can be facilitated. By making the upper panel of substantially closed design, inserting the shaft of the golf clubs into the shaft receptacles can be facilitated.

By providing the upper panel with longitudinal and transverse stiffenings, it can be stiffened in the folded-out position. Insertion can thereby be facilitated further. The longitudinal stiffenings may then be designed, for instance, as stiffening strips extending transversely to the longitudinal direction of front and back panel along the shaft receptacles. In the longitudinal direction of front and back panel, the dimension of the longitudinal stiffening may be limited. The transverse stiffenings may then be implemented, for instance, as linking mechanisms which extend between the free ends of front and back panel.

The upper panel in the folded-out position may extend slightly convexly, for instance by being convexly supported with the aid of a linking mechanism. In this way, the upper panel may be set up tautly.

By making the shaft receptacles of tubular design, it can be achieved that they guide the shafts reliably upon insertion and keep them properly in place in the inserted condition. The shaft receptacles may be of continuous design, preferably with a substantially closed wall. By making the shaft receptacles of tubular design, they can correspond well to the shape of the shaft.

By making the shaft receptacles from flexible material, it can be achieved that in the collapsed condition of front and back panel, they take up little space, and that they can easily move relative to each other to accommodate the shafts of the golf clubs in the collapsed condition. In the folded-out position, the stretching upper panel and/or the longitudinal or unfolding transverse stiffeners can set up the shaft receptacles. The shaft receptacles may therefore be tensionless in the collapsed condition and tensioned in the folded-out position. The shaft receptacles may for instance be attached at their bottoms to the bottom of the golf bag, for instance to the connecting piece between the front and back panel, or, optionally via a connector, to the bottom of the front and/or back panel. At their tops they may, near the presentation surface in the folded-out position, be attached to the golf bag, for instance to the upper panel, or to longitudinal or transverse stiffenings. By manufacturing the shaft receptacles from elastic material, or mounting them slightly elastically, setting up can be facilitated. In the folded-out position of front and back panel, the shaft receptacles may not only be extended, but also elongated with respect to the collapsed position. In both cases, the shaft receptacles in the folded-out position of front and back panel may be set up with the aid of the presentation surface. Insertion can thereby be facilitated.

Preferably, at the bottom of the golf bag the shaft receptacles are grouped in a smaller number of rows than in the presentation surface, and in the folded-out position the shaft receptacles are located in a number of planes corresponding to the number of rows of the presentation surface, whereas in the collapsed position they are located in a number of planes corresponding to the number of rows at the bottom. Thus, the shaft receptacles of a row at the bottom can, upon folding out, fan out to several rows, so that presenting is facilitated. For instance, a row of shaft receptacles can, upon folding out, fan out to two rows of shaft receptacles. The shaft receptacles of the fanned-out rows may then, for instance, be disposed alternately, but may also fan out in a different pattern.

By providing one of the panels at the top with a pull element which been passed through the other panel and with which the panels can be pulled towards each other, the golf bag can be simply collapsed by pulling the pull element and holding back the other panel.

By coupling the pull element with a shoulder strap attached to the bag, front and back panel can, upon lifting of the golf bag by the shoulder strap, be collapsed, and during carrying be kept in the collapsed position with the aid of the tensile stress in the shoulder strap.

By providing the golf bag with supporting legs which in the collapsed position of front and back panel extend along the front and back panel with free ends directed to the bottom of the golf bag, and which in the folded-out position of front and back panel run away from the front and back panel and have their free ends located at a distance from the bottom of the golf bag, it can be achieved that the golf bag in folded-out position can be stably supported at its bottom with the aid of the legs. In the collapsed position of front and back panel, the supporting legs are alongside the front and back panel and take up little space.

By having the supporting legs carried by the back panel, and coupling them via a sliding guide with the front panel, it can be achieved that folding out is facilitated. In particular, the front panel, under the influence of gravity, can pivot downwardly away from the back panel and at the same time cause the legs via the sliding guide to fold out. The supporting legs may be fitted on a top part of the back panel that faces away from the front panel. The legs may then, for instance, be coupled via a pivot. The pivot may then be arranged, for instance, on or near the upper edge of the back panel, so that the supporting legs run along the side edges of the back panel.

Elegantly, the supporting legs are pivotable about their longitudinal axis, and the sliding guide comprises a rotation/translation converter which causes the legs, upon folding out and collapse, to rotate about their axis. Especially when the supporting legs are bent, they can, upon folding out and collapse, be adjusted, by rotation, between a collapsed position in which the ends are located near each other and a folded-out position in which the ends are spaced apart more. Thus, the ends of the supporting legs in the folded-out position can provide a stable support, while in the collapsed position they take up less space and, for instance, can coincide with the front and back panels.

It is noted that the above-described technical features of the golf bag can also be advantageously used per se in a golf bag with a different configuration, i.e., the individual technical features may, if desired, be isolated from their context and be used alone, and, if desired, be combined with one or more of the above-mentioned features.

BRIEF DESCRIPTION OF THE DRAWINGS

The invention will be further elucidated on the basis of an exemplary embodiment which is represented in a drawing. In the drawing.

DETAILED DESCRIPTION

Figure 1:
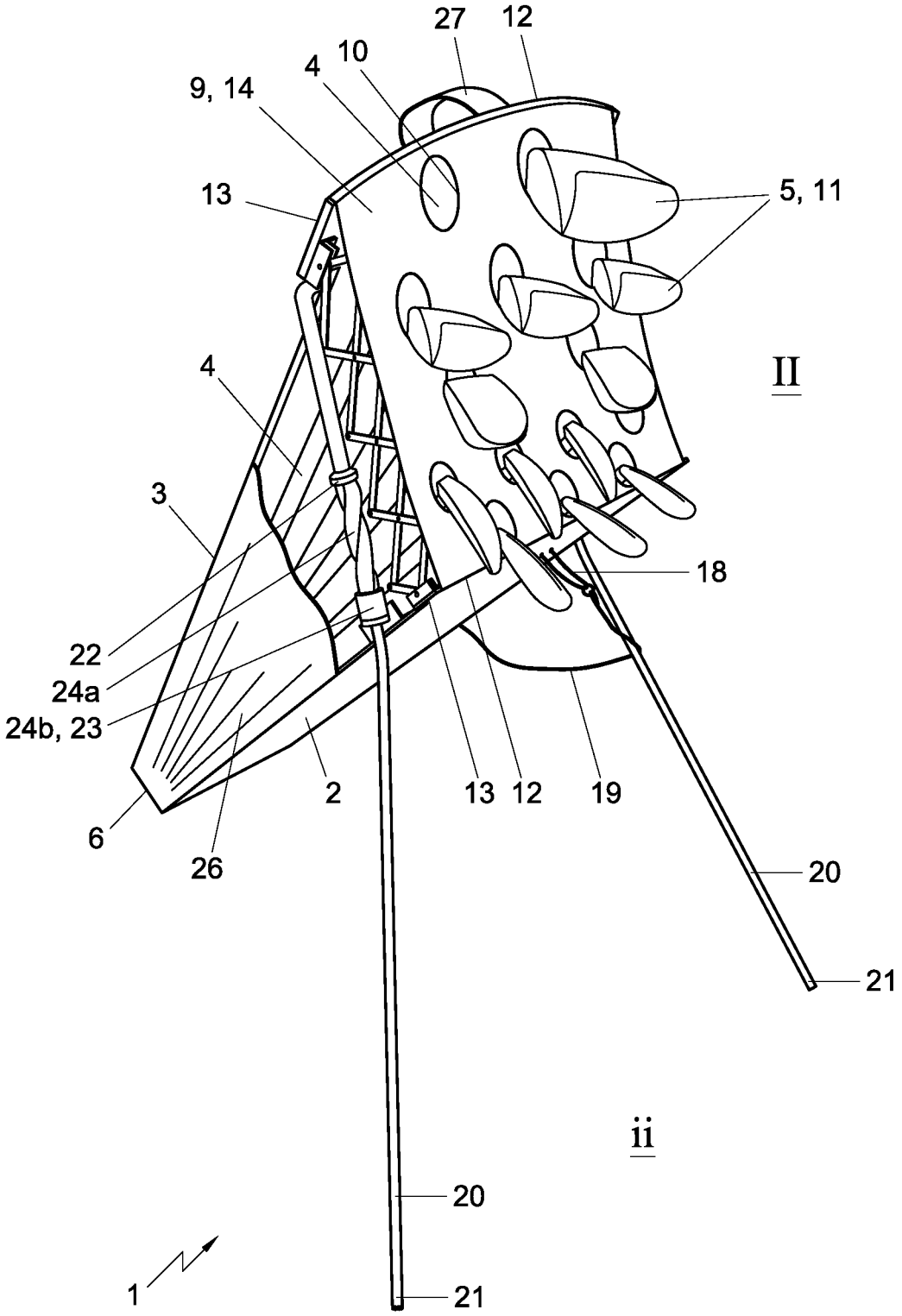
FIG. 1 shows a schematic perspective view of a golf bag with golf clubs in folded-out position.

It is noted that the figures are only schematic representations of a preferred embodiment of the invention, and that they are given by way of non-limiting exemplary embodiment only.

In the figures a golf bag 1 is shown with a front panel 2 and a back panel 3. Located between the front panel 2 and the back panel 3 is a bundle of shaft receptacles 4. The shaft receptacles 4 extend along the panels 2, 3 from the bottom to the top. In each shaft receptacle 4 a golf club 5 can be received by the shaft thereof.

Figure 8:
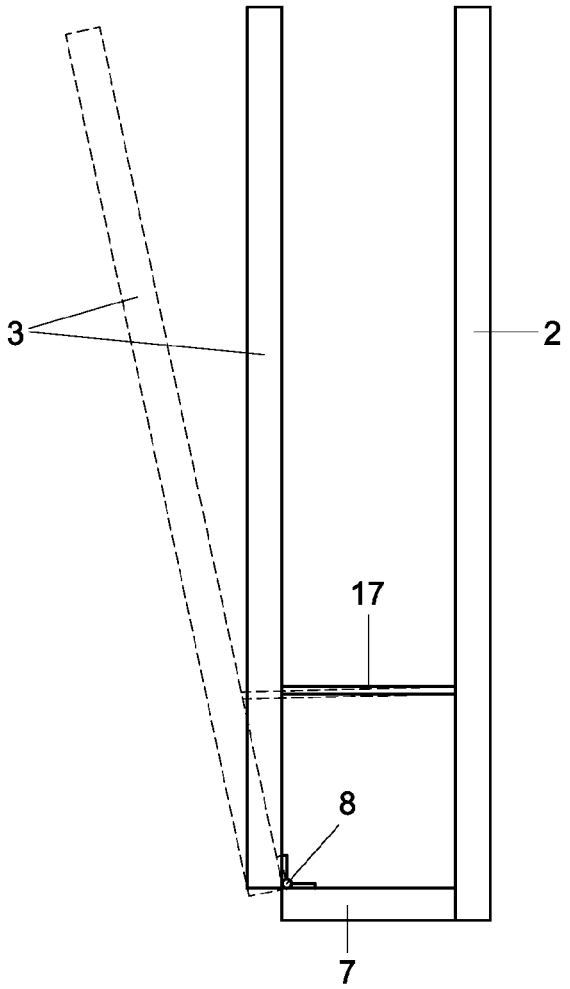
FIG. 8 shows a schematic side view of a detail of the bottom of the golf bag of FIG. 2.

The front panel 2 and the back panel 3 are pivotably connected with each other near a bottom 6. In FIG. 8 it is shown that in this exemplary embodiment this is implemented via a connecting piece 7 which connects the front panel 2 with the back panel 3. The pivotal connection is here realized with the aid of a line hinge 8 between the back panel 3 and the connecting piece 7. Of course, it is possible to connect the front panel 2 and the back panel 3 with each other in all kinds of other ways, for instance by means of a direct coupling via a flexible coupling piece.

Figure 2:
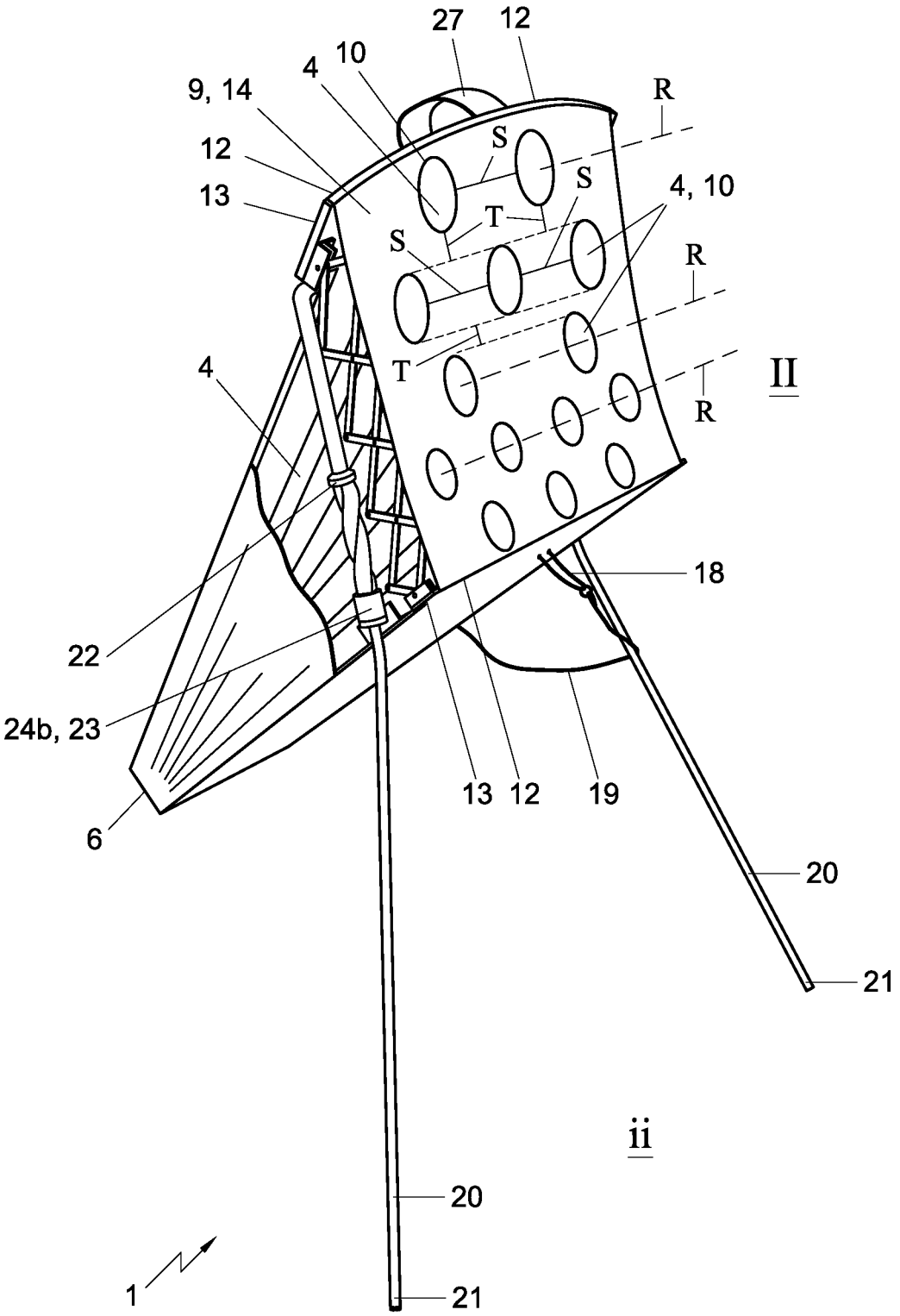
FIG. 2 shows a schematic perspective view of the golf bag of FIG. 1 without golf clubs.
Figure 3:
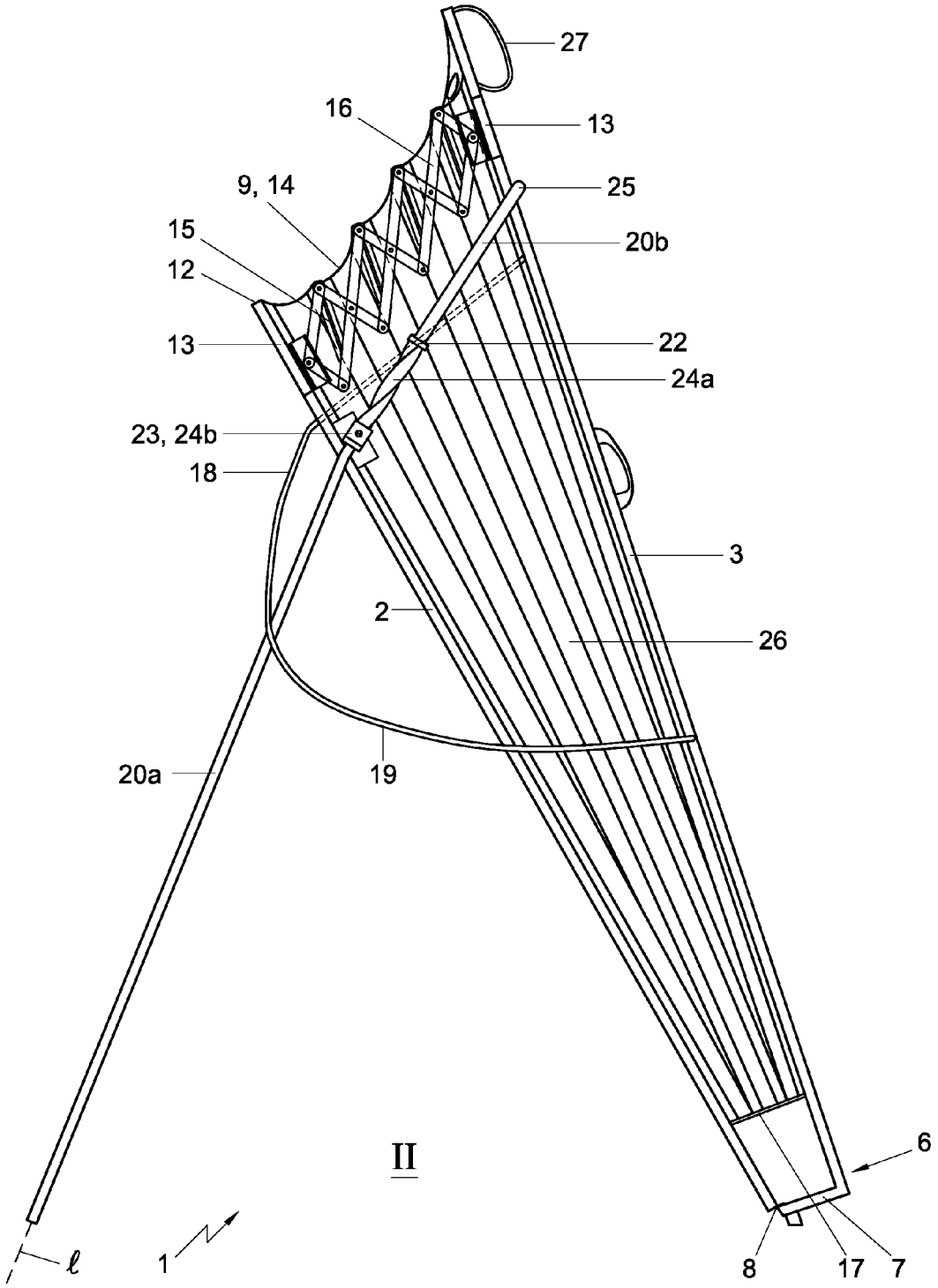
FIG. 3 shows a schematic side view of the golf bag of FIG. 2.
Figure 6:
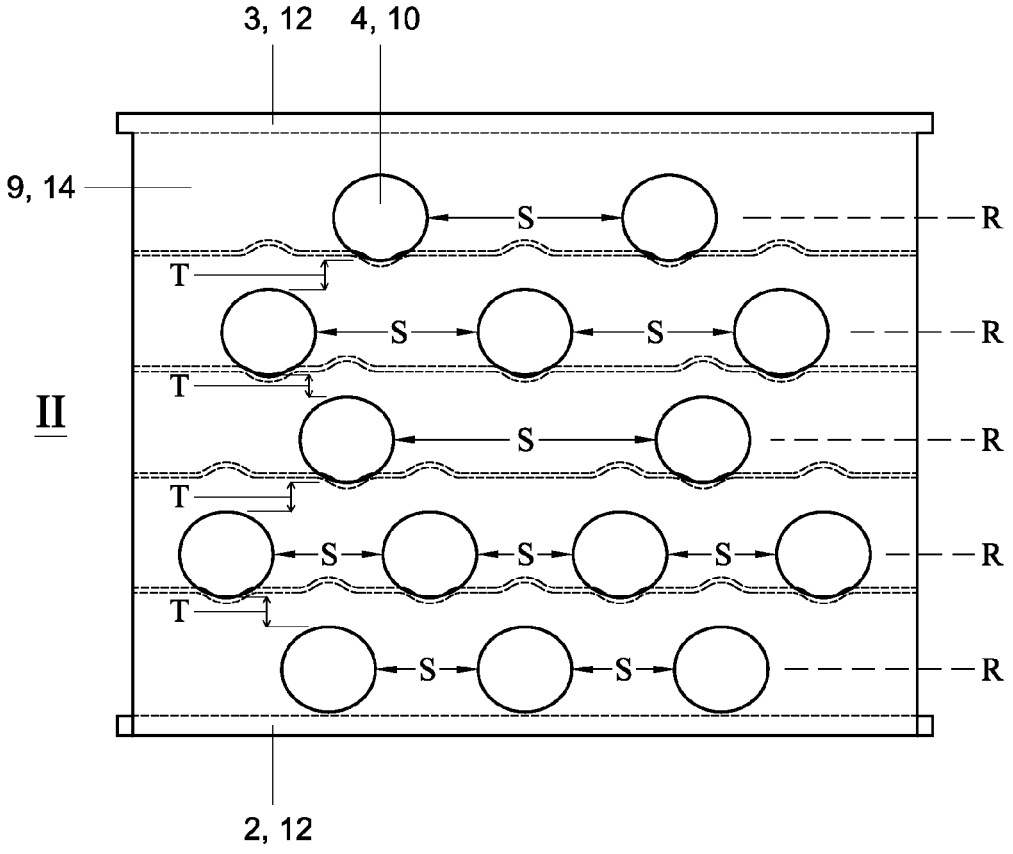
FIG. 6 shows a schematic top plan view of the golf bag of FIG. 2.
Figure 9:
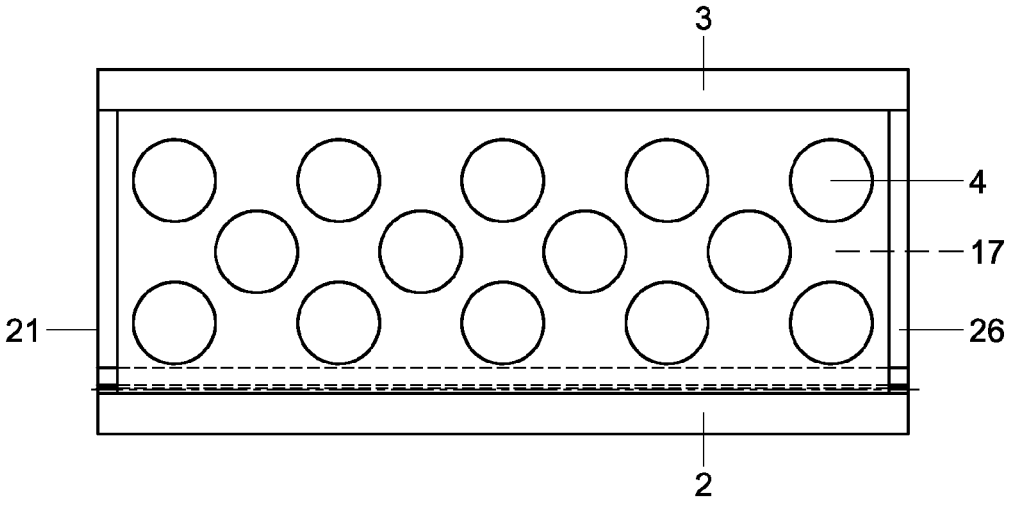
FIG. 9 shows a schematic top plan view of the detail of FIG. 8.

The front panel 2 and the back panel 3 are adjustable relative to each other between a collapsed, substantially flat position I and a folded-out, substantially wedge-shaped position II. In the collapsed position I, the front and back panel 2, 3 run substantially along each other, i.e., substantially parallel. The collapsed position I can be well seen in FIG. 8. The folded-out position II can be well seen in FIG. 2, FIG. 3 and is represented by dotted lines in FIG. 8. In the folded-out position II, the front panel 2 and the back panel 3 diverge and between the free ends of the front panel 2 and the back panel 3 a presentation surface 9 is located. The shaft receptacles 4 terminate by mouths 10 in the presentation surface 9. In the presentation surface 9, the shaft receptacles 4 are grouped in rows R with mutual spacing S. The rows R run along each other with an intermediate distance T. As a result, in the folded-out position, the mouths 10 of the shaft receptacles 4 have a matrix-like arrangement on the presentation surface. This is represented in FIG. 6. Golf clubs 5 whose shafts have been received in a shaft receptacle 4 have their heads 11 positioned on the presentation surface 9 in rows R spaced apart with an intermediate distance T. In the collapsed position I the intermediate distance T between the rows R is reduced, and the heads 11 of different rows R interdigitate, so that heads of different rows R come to lie in each other's spacing S.

The front and back panel 2, 3 are preferably of stiff design and are preferably light of weight. In the exemplary embodiment, the panels 2, 3 are made from hollow plastic plates with stiffening rib.

Front panel 2 is shorter than the back panel 3. As a result, in the collapsed position I, the heads 11 of the golf clubs 5 can be nested between the upper edges 12 of the free ends 13 of panels 2, 3. In the folded-out position II, the golf clubs on the presentation surface 9 can be easily taken out and reinserted.

The front and back panels 2, 3 taper towards the bottom to augment compactness. In the collapsed position I, the golf bag 1 is substantially flat and compact and, for instance, can be easily carried under the arm.

Figure 7:
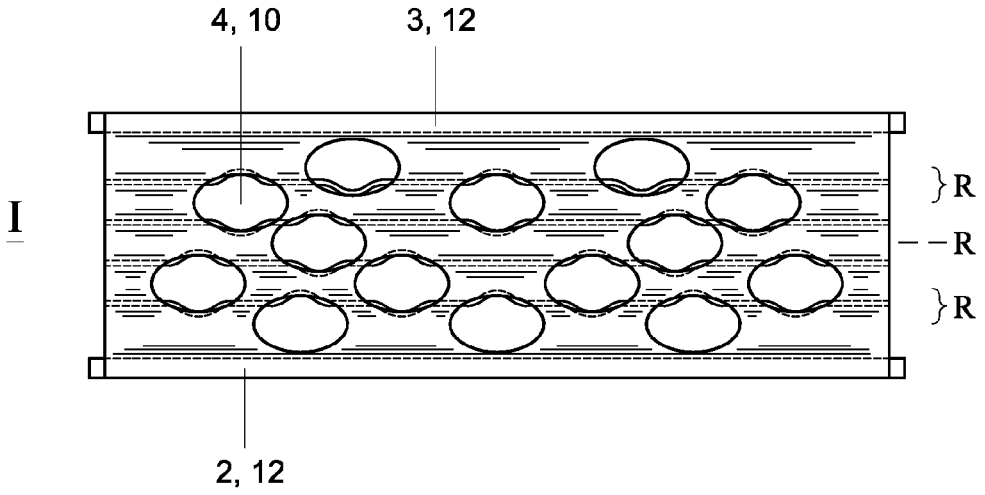
FIG. 7 shows a schematic top plan view of the golf bag of FIG. 6 in the collapsed position.
Figure 10:
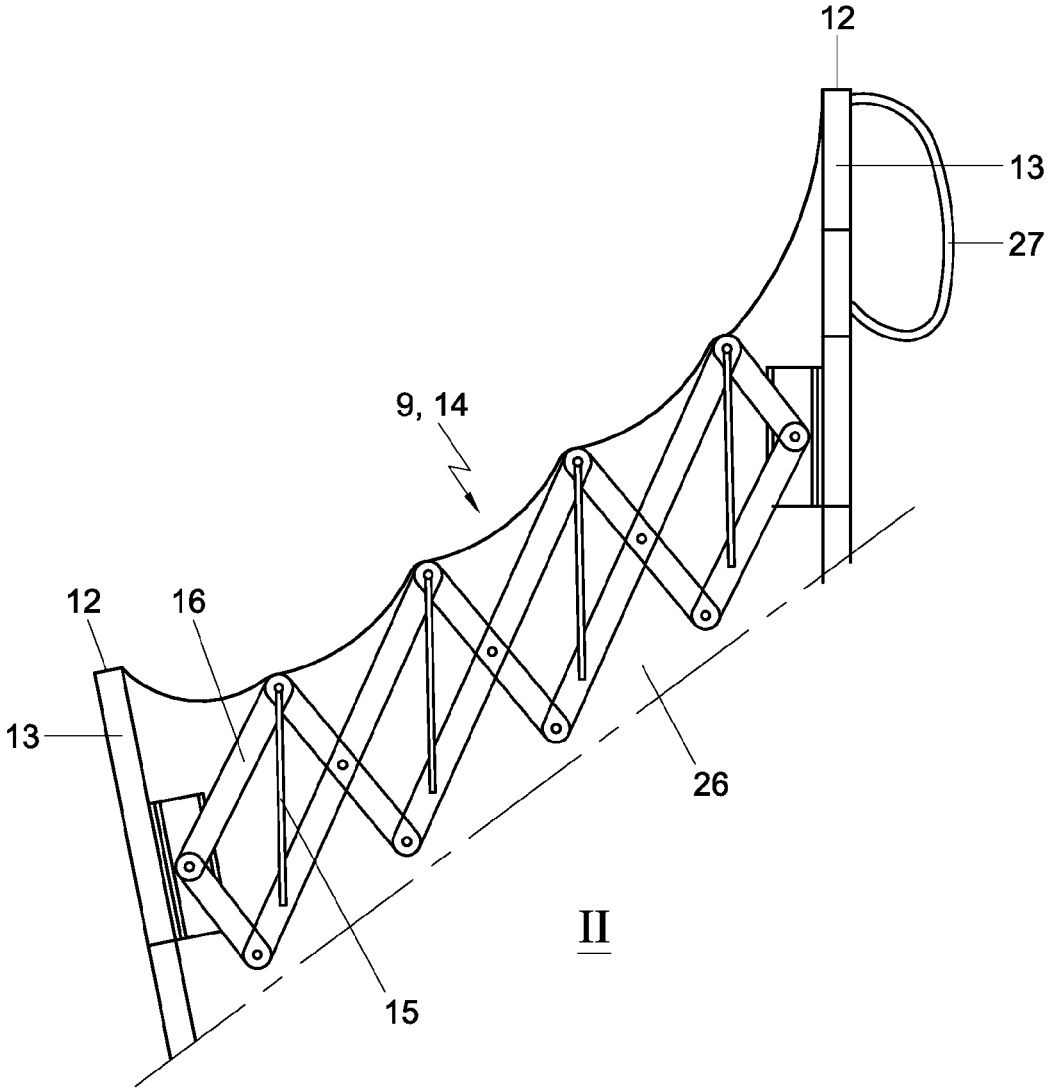
FIG. 10 shows the golf bag of FIG. 3 in folded-out state.
Figure 11:
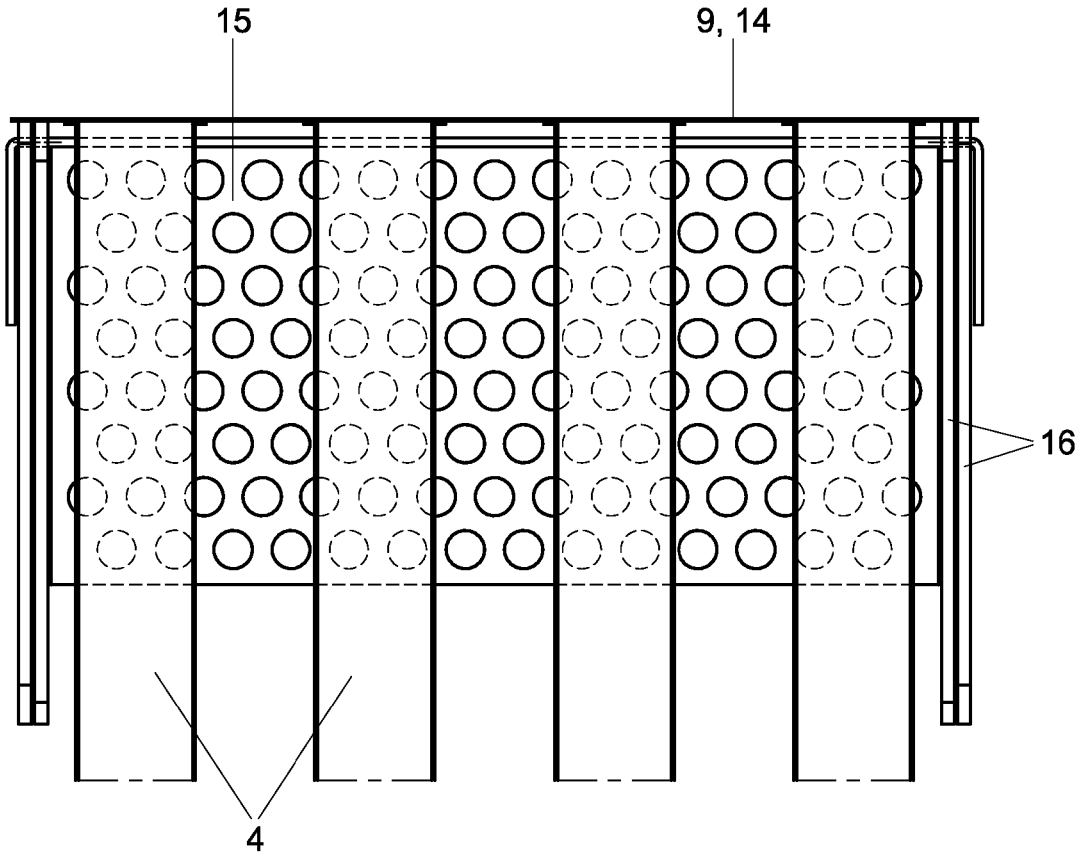
FIG. 11 shows a schematic longitudinal section of the detail view of FIG. 10.

The presentation surface 9 may be formed by an upper panel 14 which extends between the free ends of the front and back panels 2, 3. In this exemplary embodiment, the upper panel 14 is manufactured from fabric. The upper panel 14 is therefore flexible, and in the folded-out position II is extended and in the collapsed position I folded in. The upper panel 14 is of substantially closed design. The upper panel is well visible in FIGS. 6 and 7. In FIG. 10 it can further be seen that the upper panel 14 is provided with longitudinal stiffenings 15 and transverse stiffenings 16. The longitudinal stiffenings 15 are here implemented as perforate, lightweight aluminum plates. The transverse stiffenings 16 are here implemented as linking mechanisms. With the aid of the longitudinal and transverse stiffenings, the upper panel 14 can be supported in the folded-out position II, and, for instance, possibly even be set up tautly with a convex shape.

The shaft receptacles 4 are tubular, and in this exemplary embodiment are implemented as continuous tubes from flexible, stretchy cloth. The shaft receptacles 4 in the folded-out position II are elongated in longitudinal direction with respect to the collapsed position. As, between the collapsed position I and the folded-out position II, the shaft receptacles are stretched from the upper panel 14 along their longitudinal axes, they stand neatly taut and the shaft of the golf club 5 can be easily inserted.

At the bottom 6 of the golf bag 1, the shaft receptacles 4 are grouped in a smaller number of rows R than in the presentation surface 9 in the folded-out position II. In this exemplary embodiment, in the folded-out position II the shaft receptacles 4 are located in five rows R, and at the bottom 6 adjacent the mounting piece 17 in three rows. In the collapsed position I, the number of rows R at the bottom 6 corresponds to the number of rows R between the upper edges 12, viz. three. The shaft receptacles 4 are then, in the collapsed position, located in three substantially parallel planes. In the folded-out position II, the shaft receptacles 4 are located in five mutually intersecting planes.

The back panel 3 is provided at a top thereof with a pull element 18, which has been passed through the front panel 2, with which the panels 2, 3 can be pulled towards each other. In this exemplary embodiment, the pull element is implemented as a flexible cord. The pull element 18 is coupled with a shoulder strap 19 attached to the golf bag 1. In this exemplary embodiment, the free end of the cord continues in the form of a loop as a shoulder strap, and is secured at the further end to the back panel 3. By pulling the cord, the panels 2, 3 can be moved towards each other, and the golf bag 1 can be collapsed. Thereupon, the cord can be put on the shoulder, and the golf bag in collapsed condition can be carried under the arm.

Figure 4:
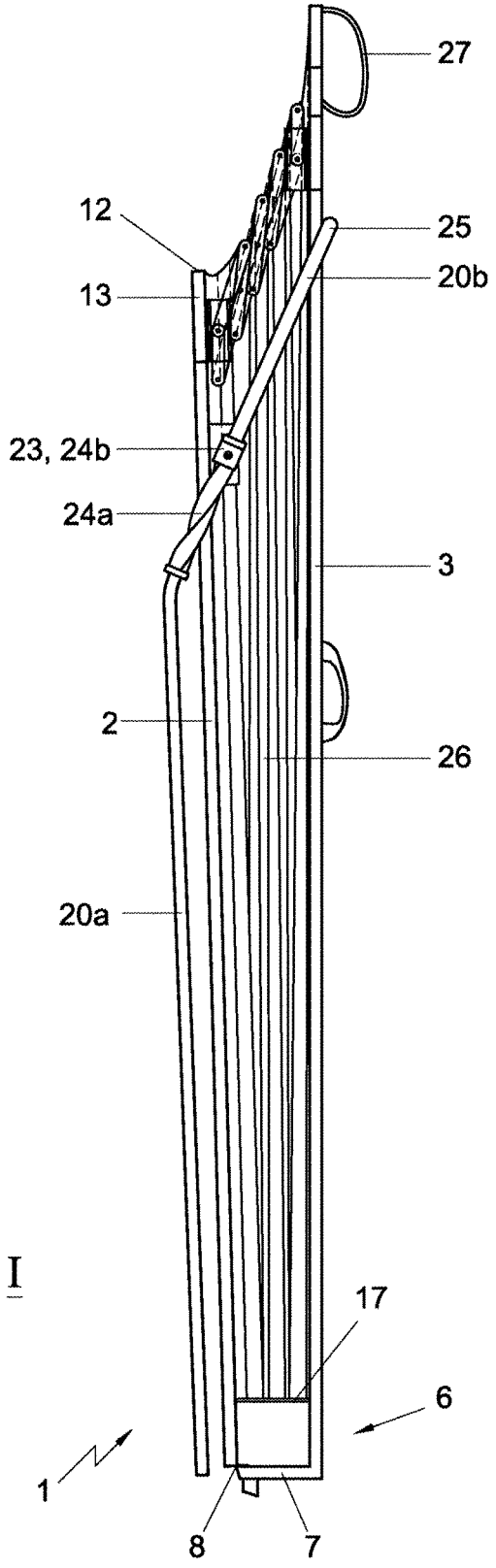
FIG. 4 shows a schematic side view of the golf bag of FIG. 3 in a collapsed position.
Figure 5:
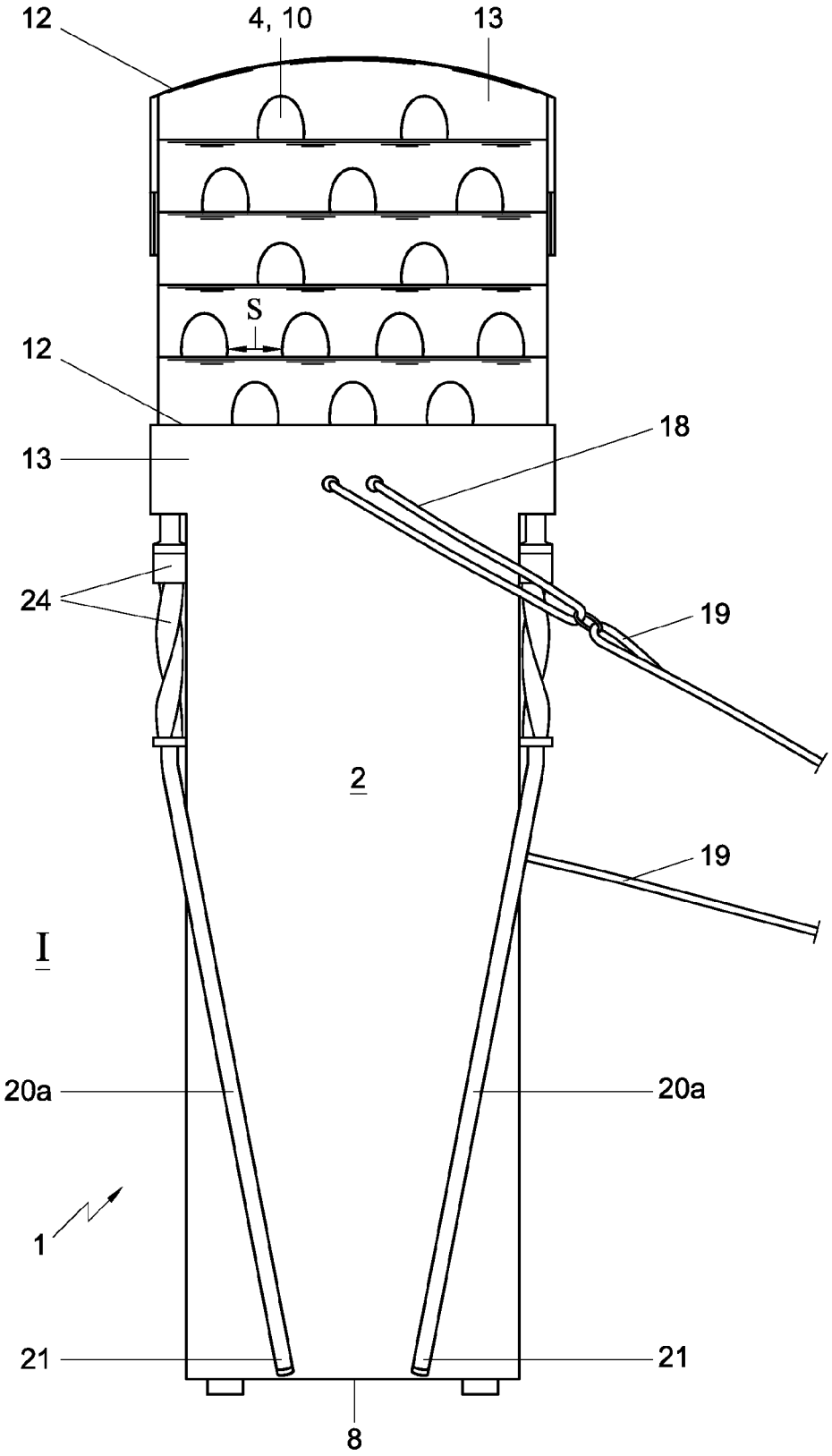
FIG. 5 shows a schematic front view of the golf bag of FIG. 4 in the collapsed position.

The golf bag 1 is furthermore provided with supporting legs 20. The supporting legs in the collapsed position I have the free ends 21 directed to the bottom 6 of the golf bag 1. In the collapsed position I, the supporting legs 20 extend along the front and back panels 2, 3. This can be well seen in FIGS. 4 and 5. In the folded-out position II of the front and back panel, the free ends 21 of the supporting legs 20 move away from the front and back panels 2, 3, and are located at a distance from the bottom 6 of the golf bag 1. This can be well seen in FIGS. 2 and 3. The supporting legs 20 are borne by the back panel 3, and are coupled with the front panel 2 via a sliding guide 22. In this exemplary embodiment, the supporting legs 20 are mounted on the top part of the back panel 3, at a distance from the upper edge 12 and on the side edges 23. In the exemplary embodiment, the supporting legs are mutually coupled via a pivot 25.

The supporting legs 20 are disposed pivotably about their longitudinal axes l. In this exemplary embodiment, this is realized in that the supporting legs 20 comprise a rotatable part 20*a* which via a bearing 22 is turnably connected with a non-rotatable part. The sliding guide 23 is provided with a rotation-translation converter 24 which causes the rotatable part 20*a* of supporting legs 20 to rotate about their longitudinal axes l upon collapse and folding-out of the bag. In this exemplary embodiment, the rotatable part 20*a* of the supporting legs 20 is provided with a worm 24*a* which cooperates with a driving guiding eye 24*b* of the sliding guide 23. The rotatable parts 20*a* of the supporting legs 20 are bent, and, with the aid of the rotation-translation converter 24 are adjusted, upon collapse and folding-out of the bag, by rotation, between a collapsed position i in which the ends 21 are located near each other and a folded-out position ii in which the ends 21 are located further apart.

The golf bag 1 is furthermore provided with flexible side panels 26, in this exemplary embodiment from flexible fabric, and with a grip 27 to facilitate collapse and folding out, as well as lifting.

It is noted that the golf bag 1 may further be provided with a covering hood, not represented in the figures for the sake of easy reference, for covering the upper panel 14, to protect the heads 11 of the golf clubs 5. Further, the golf bag 1 may be provided with all kinds of compartments for taking along, for instance, golf accessories, articles of clothing, food and drinks.

Figure 12:
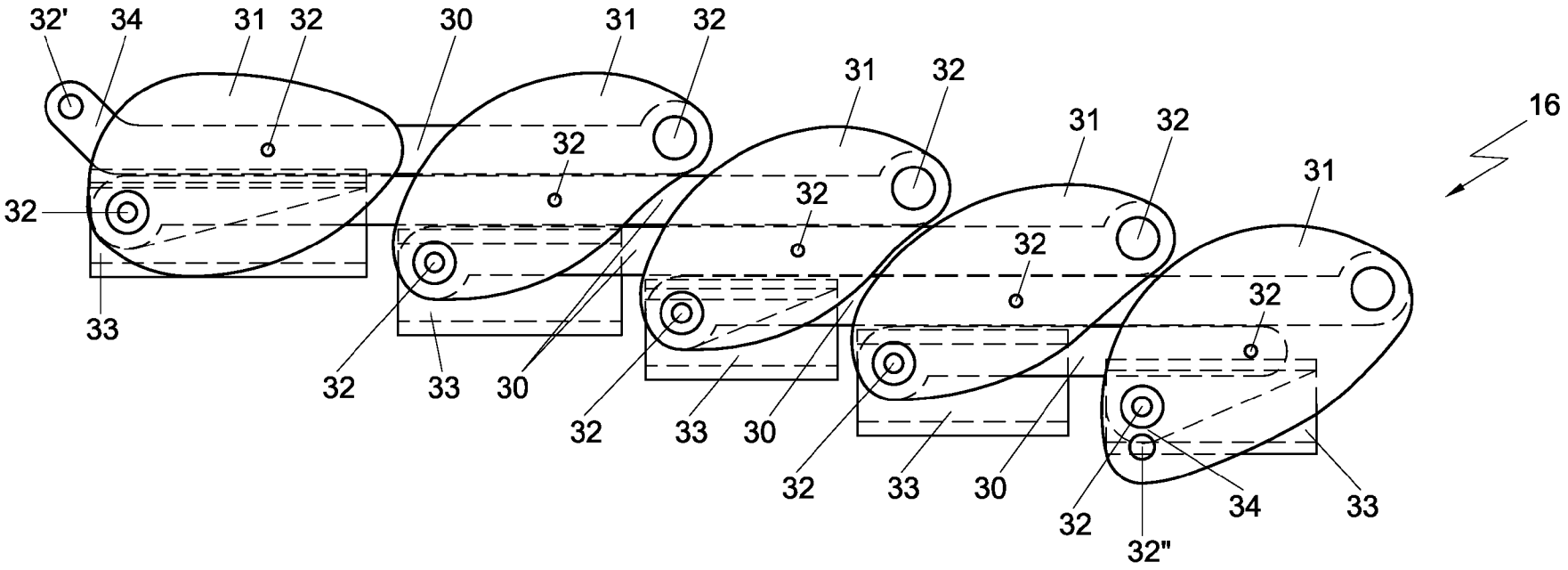
FIG. 12 shows a schematic side view of a longitudinal stiffening implemented as a linking mechanism.

In FIG. 12 an alternative linking mechanism for the longitudinal stiffening 16 is shown. The linking mechanism of the longitudinal stiffening 16 is equipped with a series of longitudinal rods 30, which are connected with transverse rods 31 which are shorter than the longitudinal rods 30. The longitudinal rods 30 are here of bar-shaped design. The longitudinal rods 30 are of substantially equal length and, in a collapsed position, can overlap each other in a stepped manner, so that with respect to a central longitudinal rod, in each case a longitudinal rod that is lower in the side view of FIG. 12 extends in the figure forwards beyond the central longitudinal rod, and an upper longitudinal rod extends rearwards beyond the central longitudinal rod. The transverse rods 31 are then likewise of substantially equal length and extend in the figure from the bottom to the top obliquely forwards. The transverse rods 31 are here of cam-shaped design. The transverse rods in each case are hingedly connected via line hinges 32 with the center of an intermediate longitudinal rod, with the front end of a rearwards extending longitudinal rod, and with the rear end of a forwards extending longitudinal rod. The transverse rods 31 can then hinge about the center of the central transverse rods like a lever, so that the mechanism can be brought from the collapsed position shown in the figure to a widened folded-out position in which the upper ends of the transverse rods can support the upper panel 14. The upper hinge points of two linking mechanisms are coupled to flanged ends 33 of longitudinal stiffenings 15 designed as strips. The first, uppermost longitudinal rod 30 is designed without rearwards reaching part. The transverse rod 31 shown first on the left in the figure is, near the upper hinge point, via an upwards and rearwards reaching arm 34 with a line hinge 32' hingedly coupled with the back panel 3. The transverse rod 31 drawn last on the right in the figure is of shortened design, and the last longitudinal rod 30 of the packet is provided with a downwards and forwards extending arm 34 which is hingedly coupled via a line hinge 32" with the front panel 2. By providing such arms 34 on the first transverse rod and the last longitudinal rod, the linking mechanism in the folded-out position can assume an arcuate shape, so that it can support the upper panel 14 convexly. By making the transverse rods of cam-shaped design, they can in a collapsed position impose a desired minimal intermediate distance between the rows of shaft receptacles 4, and to some extent screen off the packet of longitudinal rods 30.

Further, front and back panel may be implemented as stiff plates, for instance from lightweight sandwich plates or hollow plates with stiffenings, for instance from aluminum and/or fiber-reinforced plastic material. By providing such stiff plates with upstanding longitudinal edges, the stiffness of the plates can be further augmented. The upstanding longitudinal edges may advantageously cooperate in the collapsed position to form the sidewalls of the golf bag. Thus, the golf bag in the collapsed position forms a stiff, flat box. Such a stiff flat box is easy to carry under the arm, and, when for instance a covering hood over the heads of the golf clubs is provided, lends itself well for independent transport in the hold of an airplane. In the folded-out position, the sidewalls are then substantially open, so that the shaft receptacles are visible like a flower bouquet. This provides a fine, open look, and saves weight of closed side panels.

By making the longitudinal stiffeners of strip-shaped design, the golf bag may be free of partitions extending lengthwise between the front and back panels. This reduces the weight, and augments the compactness in collapsed condition. The longitudinal stiffeners may be provided with positioning provisions corresponding to the positions of the shaft receptacles, for positioning the shaft of a golf club. The positioning provisions may be implemented, for instance, as corrugations or grooves in the plates which are open towards the front panel for supporting a part of the shaft of a golf club.

The golf clubs of the set that have shorter shafts can be received in rows located nearer to the front panel, and golf clubs with longer shafts in rows nearer to the back panel. In the collapsed position of the golf bag, the golf clubs are then located in rows with their lances near each other, so that the length of the back panel can be tailored to the longer golf clubs of the set, and the length of the front panel to the length of the shorter golf clubs of the set. Thus, the compactness of the golf bag can be augmented.

The shaft receptacles may be connected near their lower ends with the front panel, the back panel, or with a connecting piece. At their lower ends, the shaft receptacles may, for instance, be fixedly or detachably connected with the golf bag. They may be secured each separately, or in groups. They may be secured, for instance, on a detachable plate in three rows. If the shaft receptacles are of tubular design, they may be of open design at their lower ends for the purpose of simplified cleaning. By making the shaft receptacles from tubular, elastic material, and stretching them in the folded-out position, inserting the golf clubs can be very easy. In the folded-out position of the golf bag, the shaft receptacles preferably extend like a bunch of flower sterns, with the shafts located in a number of diverging planes, and with the shafts in each plane running parallel with a mutual intermediate distance.

Furthermore, the shoulder strap may be part of a carrying harness which also comprises a second shoulder strap, so that the golf bag can optionally be carried flat on one's back like a backpack. Further, the shoulder strap may be provided with an arcuate stiffening, so that in unused condition it is open for taking up an arm of a user. Advantageously, the user can then, in the folded-out position of the golf bag, when it is stood on its supporting legs, readily pass his arm through the shoulder strap. Upon taking the golf bag on the shoulder, the carrying strap will operate the pull element. Front and back panel then move towards each other, for instance in that back panel is held back by the body, and the front panel, due to the weight of the golf bag, is pulled towards the back panel via the operating cord coupled with the shoulder strap, and during carrying is sustained in that condition. Thereupon the golf bag can be clamped as a flat pack between arm and body. The approximating movement of the front and back panel causes the supporting legs via the rotation-translation converter to collapse as the golf bag is taken on the shoulder. Thus, the golfer, sportsmanlike, can carry the golf bag comfortably himself, which can afford an original sports sensation.

It will be clear to those skilled in the art that the invention is not limited to the exemplary embodiments discussed here, but that many variants of embodiments are possible within the scope of the invention as set forth in the appended claims.

What is claimed is:

1. A golf bag, comprising:

a front panel and a back panel having therebetween a bundle of shaft receptacles for therein receiving a golf club by the shaft thereof, an upper end of the shaft receptacles being flexible and collapsible;

wherein front and back panel are pivotably connected with each other at a bottom of the golf bag, and are adjustable relative to each other between a collapsed, substantially flat position in which front and back panel run substantially along each other, and a folded-out, substantially wedge-shaped position in which front and back panel diverge and in which between their free ends a presentation surface is located in which the shaft receptacles terminate and with mutual spacing are grouped in rows which run along each other with an intermediate distance, so that golf clubs whose shaft is received in a shaft receptacle have their heads positioned on the presentation surface in rows spaced apart with an intermediate distance.

2. The golf bag according to claim 1, wherein the presentation surface is formed by an upper panel which extends between the free ends of the front and back panels.

3. The golf bag according to claim 1, wherein the shaft receptacles are tubular.

4. The golf bag according to claim 1, wherein the shaft receptacles are manufactured from flexible material.

5. The golf bag according claim 1, wherein the shaft receptacles in the folded-out position are extended.

6. The golf bag according to claim 1, wherein the shaft receptacles are comprised of flexible material, and in the collapsed position are untensioned, and in the folded-out position are tensioned.

7. The golf bag according claim 1, wherein one of the panels is provided at a top with a pull element which has been passed through the other panel, with which the panels can be pulled towards each other.

8. The golf bag according to claim 7, wherein the pull element is coupled with a shoulder strap attached to the bag.

9. The golf bag according to claim 1, wherein the golf bag is provided with supporting legs which in the collapsed position of front panel extend along the front panel with free ends adjacent the bottom of the golf bag, and which in the folded-out position of front panel run away from the front panel and have their free ends located at a distance from the bottom of the golf bag.

10. The golf bag according to claim 9, wherein the supporting legs are coupled with the front panel via a sliding guide.

11. The golf bag according to claim 10, wherein the supporting legs are pivotable about their longitudinal axis, and wherein the sliding guide comprises a rotation-translation converter which causes the legs to rotate about their axis upon collapse and folding out.

12. The golf bag according to claim 9, wherein the supporting legs are bent, and upon collapse and folding out are adjusted, by rotation, between a collapsed position in which the ends are located near each other and a folded-out position in which the ends are spaced apart more.

13. A golf bag, comprising:

a front panel and a back panel having therebetween a bundle of shaft receptacles for therein receiving a golf club by the shaft thereof, an upper end of the shaft receptacles being flexible and collapsible;

wherein front and back panel are pivotably connected at a bottom of the golf bag, and are adjustable relative to each other between a collapsed, position in which front and back panel run substantially along each other, and a folded-out, substantially wedge-shaped position in which front and back panel diverge and in which between their free ends a presentation surface is located in which the shaft receptacles terminate and with mutual spacing are grouped in rows which run along each other with an intermediate distance, so that golf clubs whose shaft is received in a shaft receptacle have their heads positioned on the presentation surface in rows spaced apart with an intermediate distance.

14. A golf bag, comprising:

a front panel and a back panel having therebetween a bundle of shaft receptacles for therein receiving a golf club by the shaft thereof, wherein front and back panel are connected with each other, and are adjustable relative to each other between a collapsed, substantially flat position in which front and back panel run substantially along each other, and a folded-out, substantially wedge-shaped position in which front and back panel diverge and in which between their free ends a presentation surface is located in which the shaft receptacles terminate and with mutual spacing are grouped in rows which run along each other with an intermediate distance, so that golf clubs whose shaft is received in a shaft receptacle have their heads positioned on the presentation surface in rows spaced apart with an intermediate distance; and wherein the shaft receptacles at the bottom of the golf bag are grouped in a smaller number of rows than in the presentation surface, and the shaft receptacles in the folded-out position are located in a number of planes corresponding to the number of rows of the presentation surface, and in the collapsed position are located in a number of planes corresponding to the number of rows at the bottom.

* * * * *